US008641036B2

(12) United States Patent
Nishikata et al.

(10) Patent No.: US 8,641,036 B2
(45) Date of Patent: Feb. 4, 2014

(54) SHEET FEEDING APPARATUS AND IMAGE FORMING APPARATUS

(75) Inventors: Kazushi Nishikata, Odawara (JP); Shinichi Ueda, Mishima (JP); Satoshi Tsuda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/612,642

(22) Filed: Sep. 12, 2012

(65) Prior Publication Data

US 2013/0001861 A1 Jan. 3, 2013

Related U.S. Application Data

(62) Division of application No. 12/962,332, filed on Dec. 7, 2010, now Pat. No. 8,333,375.

(30) Foreign Application Priority Data

Dec. 10, 2009 (JP) ..... 2009-281003

(51) Int. Cl.
*B65H 1/14* (2006.01)

(52) U.S. Cl.
USPC ..... 271/156; 271/152; 271/147; 271/127; 271/153

(58) Field of Classification Search
USPC ..... 271/127, 126, 156, 160
See application file for complete search history.

(56) References Cited

FOREIGN PATENT DOCUMENTS

| | | | | |
|---|---|---|---|---|
| JP | 01069424 | A | * | 3/1989 |
| JP | H06-056283 | A | | 3/1994 |
| JP | 08108942 | A | * | 4/1996 |
| JP | 2002-167058 | A | | 6/2002 |
| JP | 2007-031069 | A | | 2/2007 |

* cited by examiner

*Primary Examiner* — Luis A Gonzalez
(74) *Attorney, Agent, or Firm* — Canon USA Inc. IP Division

(57) ABSTRACT

A sheet feeding apparatus includes a sheet accommodating unit which is detachably attached to an apparatus main body and configured to accommodate sheets, a sheet stacking unit which is provided in the sheet accommodating unit and can move while supporting the sheet, a sheet feeding unit configured to feed the sheet stacked on the sheet stacking unit, and a lift unit configured to move the sheet stacking unit toward the sheet feeding unit, wherein, before feeding of the sheet stacked on the sheet stacking unit by the sheet feeding unit, the lift unit increases and then reduces press contact force between the sheet stacked on the sheet stacking unit and the sheet feeding unit.

4 Claims, 11 Drawing Sheets

L1: PLAIN PAPER (WITH SHEET FEEDING PRESSURE LOSS)
L2: PLAIN PAPER (WITHOUT SHEET FEEDING PRESSURE LOSS)
L3: PLAIN PAPER (WITH CORRECTION)
H1: HEAVY PAPER (WITH SHEET FEEDING PRESSURE LOSS)
H2: HEAVY PAPER (WITHOUT SHEET FEEDING PRESSURE LOSS)
H3: HEAVY PAPER (WITH CORRECTION)

SHEET FEEDING APPARATUS AND IMAGE FORMING APPARATUS

CROSS-REFERENCE TO RELATED APPLICATIONS

This application is a divisional of application Ser. No. 12/962,332 filed Dec. 7, 2010 that claims the benefit of Japanese Patent Application No. 2009-281003 filed Dec. 10, 2009, both of which are hereby incorporated by reference in their entirety.

BACKGROUND OF THE INVENTION

1. Field of the Invention

The present invention relates to a sheet feeding apparatus provided in an electrophotographic type or an electrostatic recording type image forming apparatus, such as a copying machine, a laser beam printer (LBP), or a facsimile apparatus, and adapted to feed sheets accommodated in a sheet feeding cassette successively to an image forming unit.

2. Description of the Related Art

Conventionally, in an image forming apparatus, such as a copying machine, a laser beam printer (LBP), or a facsimile apparatus, there is provided a sheet feeding apparatus that has a sheet feeding cassette detachable with respect to the apparatus main body and accommodating a sheet bundle consisting of a plurality of sheets, with the accommodated sheets being separated one by one and sent out to an image forming unit.

The sheet feeding apparatus is equipped with a sheet stacking plate supporting the sheet bundle within the sheet feeding cassette, and a lift unit raising the sheet stacking plate toward a feeding roller. The lift unit raises the sheet stacking plate by driving force of a drive source such as a motor, and presses an upper surface of a sheet supported by the sheet stacking plate against the feeding roller. In the sheet feeding apparatus, the feeding roller rotates, with the sheet and the feeding roller in press contact with each other, and the uppermost sheet is fed by frictional force of the feeding roller. As the lift unit, there is known a device having an operation unit raising the sheet stacking plate in the sheet feeding cassette after the sheet feeding cassette has been attached to the apparatus main body, and a lifter drive mechanism providing press contact force (hereinafter referred to as the sheet feeding pressure) to the sheet and the feeding roller via a pressurizing unit such as a spring. This technique is discussed in Japanese Patent Application Laid-Open No. 2006-56685.

However, in the sheet feeding apparatus equipped with the lift unit described above, when the lift unit raises the sheet stacking plate, the sheet feeding pressure may decrease due to sliding resistance between the sheet bundle on the sheet stacking plate and a side regulating member for regulating a side surface of the sheet bundle. This occurs because the side regulating member is maintained in a fixed state while the sheet stacking plate is rising.

This situation will be described with reference to a drawing. FIG. 10 illustrates a state in which a sheet bundle on a sheet stacking plate 31 is receiving sliding resistance from a side regulating member 32. When the sheet stacking plate 31 is lifted by the lift unit, it is done so with a sheet bundle end surface being rubbed against a regulating surface of the side regulating member 32. As indicated by arrows A in FIG. 10, in this state, the sheet bundle receives from the side regulating member 32 a force in a direction opposite to a direction of force (indicated by an arrow B) received from the sheet stacking plate 31. This force (indicated by the arrows A) constitutes resistance in lifting the sheet stacking plate 31, resulting in reduction in sheet feeding pressure. In this way, when the sheet feeding pressure is reduced, the sheet feeding roller cannot acquire requisite conveyance force, so that, in some cases, the sheet feeding apparatus fails to feed.

The larger a sheet size, the larger basic weight, and the larger a stacking amount, the more conspicuous is this tendency. The reduction in the sheet feeding pressure as described above is likely to be generated immediately after the lift-up operation to raise the sheet stacking plate. This is due to the fact that, while the sheets are being successively fed, vibration due to an apparatus operation such as a rotating operation of the sheet feeding roller is transmitted to the sheet stacking plate and the sheets, and due to the vibration, the rubbing of the sheet bundle end surface against the side regulating member as shown in FIG. 10 may be canceled.

FIG. 11 illustrates a relationship between the sheet stacking amount and the sheet feeding pressure when a predetermined pressure is provided to the sheet stacking plate 32. A line H1 indicates the relationship between a heavy paper sheet stacking amount and sheet feeding pressure, showing that, the larger the stacking amount, the greater the reduction in sheet feeding pressure. This is due to the fact that, when the sheet stacking amount increases, a rubbing area between the sheet bundle end surface and the side regulating member increases. A line H2 indicates the relationship between the sheet stacking amount and the sheet feeding pressure in the case where there is no reduction in the sheet feeding pressure due to sliding resistance. Similarly, a line L1 indicates the relationship between a plain paper sheet stacking amount and the sheet feeding pressure. A line L2 indicates the relationship between the sheet stacking amount and the sheet feeding pressure in the case where there is no reduction in the sheet feeding pressure due to sliding resistance. Comparison of the lines L1 and L2 shows that, although the reduction in the sheet feeding pressure becomes greater as the stacking amount increases, its influence is smaller as compared with the relationships of the lines H1 and H2 in the case of heavy paper sheets. As indicated by the line H1, when the reduction in the sheet feeding pressure becomes greater, a shortage of sheet feeding pressure occurs, and there is a fear of feeding failure occurring.

To cope with this problem, it might be possible to increase the pressure applied to the sheet stacking plate so as to compensate for the reduction in sheet feeding pressure, and to set the heavy paper sheet feeding pressure as indicated by a line H3. However, in the case of this setting, the plain paper sheet feeding pressure becomes higher than necessary as indicated by a line L3, and there is a fear of double feeding occurring.

In recent years, an image forming apparatus such as a copying machine, an LBP, or a facsimile apparatus, has been requested to be compatible with various sizes and types of sheets. Such sheets of various sizes and types include heavy sheets such as an ultra-heavy paper sheet in excess of 200 $gf/m^2$, and a gloss coated paper sheet for high-quality color printing, and light sheets such as an ultra-light sheet, and a small size sheet of A6 size or card size. This means that, in FIG. 11, a difference in sheet feeding pressure between the line H1 which is the lower limit value for preventing feeding failure and the line L1 which is the upper limit value for preventing double feeding becomes greater. Thus, when the pressure applied to the sheet stacking plate is increased so as to compensate for the reduction in the sheet feeding pressure the heavy paper indicated by the line H1, the sheet feeding pressure of the plain paper indicated by the line L3 increases unnecessarily, so that the possibility of generation of double feeding increases. In this situation, for the image forming apparatus to be compatible with sheets of various types and sizes with a single pressurization unit, it is necessary to mitigate the reduction in the sheet feeding pressure due to the sliding resistance between the sheet bundle and the side regulating member.

In connection with this problem, there is known a configuration in which the pressure applied to the sheet stacking plate is switched according to a size and a type of a sheet. However, when such a configuration is adopted, it is necessary to additionally provide a detection unit for detecting the size and type of sheet, and to provide a mechanism for switching between a plurality of pressurization units, resulting in an increase in the number of components and an increase in cost. There is also known a system in which the pressure applied to the sheet stacking plate is switched according to the size and type of sheet. However, there is a fear of the user making an erroneous setting in this system. When sheets of different specifications from the setting are accommodated within the sheet feeding cassette, the sheet feeding pressure with respect to the sheet specifications is not optimum, and there is a fear of double feeding and feeding failure.

The above described problem of the reduction in the sheet feeding pressure is not restricted to the lift unit configuration as described with reference to the conventional example. A similar problem can arise in any configuration in which a sheet bundle on a sheet stacking plate is lifted while in sliding contact with a side regulating member regulating a side surface of the sheet bundle.

SUMMARY OF THE INVENTION

The present invention is directed to a sheet feeding apparatus of a simple configuration capable of mitigating a reduction in sheet feeding pressure.

According to an aspect of the present invention, a sheet feeding apparatus including a sheet accommodating unit which is detachably attached to an apparatus main body and configured to accommodate sheets, a sheet stacking unit which is provided in the sheet accommodating unit and can move while supporting the sheet, a sheet feeding unit configured to feed the sheet stacked on the sheet stacking unit, and a lift unit configured to move the sheet stacking unit toward the sheet feeding unit, wherein, before feeding of the sheet stacked on the sheet stacking unit by the sheet feeding unit, the lift unit increases and then reduces press contact force between the sheet stacked on the sheet stacking unit and the sheet feeding unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

As an example of an image forming apparatus equipped with a sheet feeding apparatus according to the present invention, exemplary embodiments as applied to an electrophotographic color laser beam printer will be specifically described below. However, unless otherwise specified, sizes, materials, configurations, and relative arrangement of components of the exemplary embodiments should not be construed as limiting the scope to the present invention. Further, the sheet feeding apparatus according to the present invention is not limited to a color laser beam printer but is also applicable to other image forming apparatuses such as a copying machine, and a facsimile apparatus.

Figure 1:
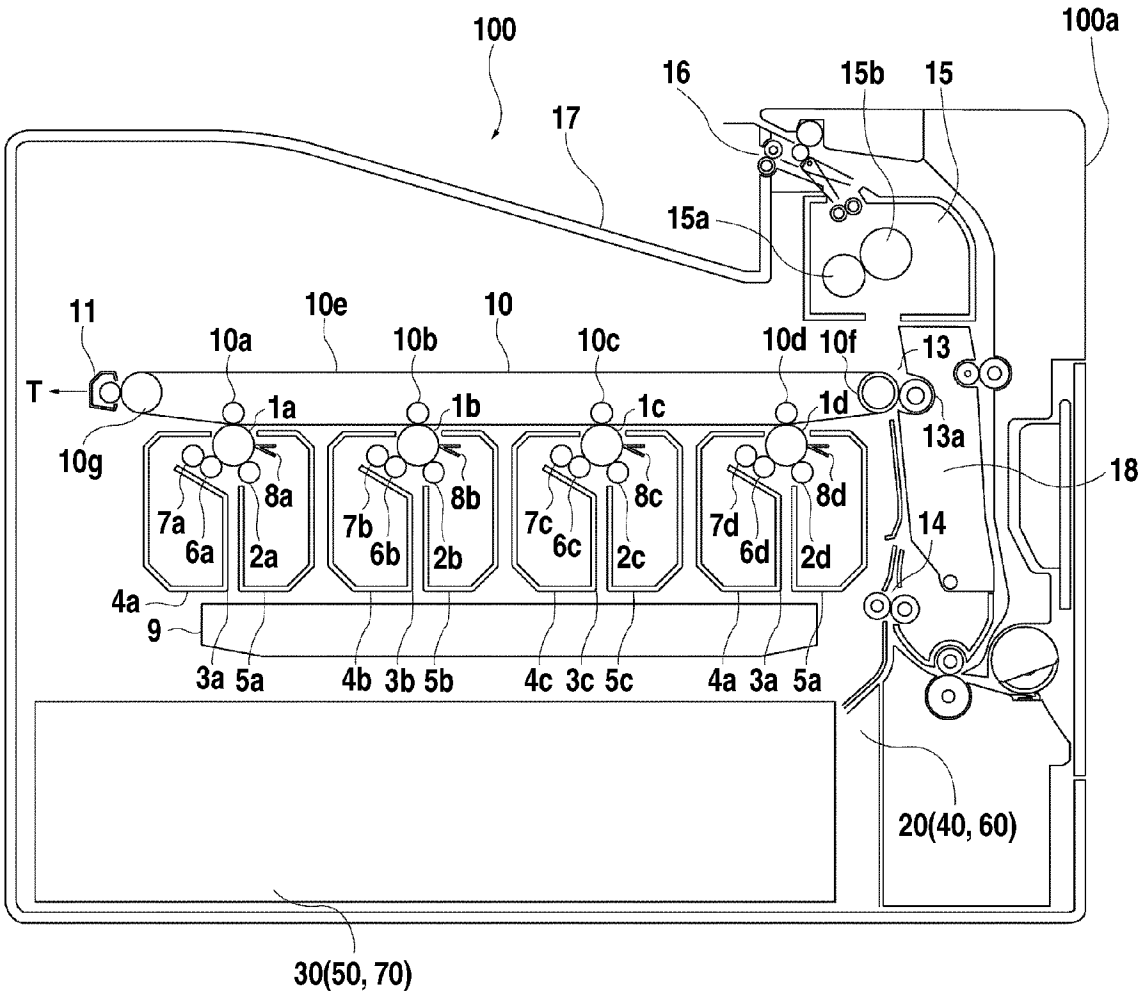
FIG. 1 is a schematic sectional view of an image forming apparatus equipped with a sheet feeding apparatus according to the present invention.

A general configuration of the image forming apparatus will be described, and then the sheet feeding apparatus, which is a feature of the present invention, will be described in detail. The general configuration of the image forming apparatus will be schematically described with reference to FIG. 1. FIG. 1 is a schematic sectional view of the image forming apparatus equipped with the sheet feeding apparatus according to the present invention.

[Image Forming Unit]

An image forming apparatus (hereinafter referred to as a printer unit) 100 is equipped with process cartridges 3*a*, 3*b*, 3*c*, and 3*d* detachable with respect to an image forming apparatus main body 100*a*. These four process cartridges 3*a*, 3*b*, 3*c*, and 3*d* are of the same structure. They perform image formation using toners of different colors of yellow (Y), magenta (M), cyan (C), and black (Bk).

The process cartridges 3*a*, 3*b*, 3*c*, and 3*d* are respectively formed by development units 4*a*, 4*b*, 4*c*, and 4*d*, and cleaner units 5*a*, 5*b*, 5*c*, and 5*d*. The former, i.e., the development units 4*a*, 4*b*, 4*c*, and 4*d* respectively include development rollers 6*a*, 6*b*, 6*c*, and 6*d*, developer applying rollers 7*a*, 7*b*, 7*c*, and 7*d*, and toner containers. On the other hand, the latter, i.e., the cleaner units 5*a*, 5*b*, 5*c* and 5*d* respectively include photosensitive drums 1*a*, 1*b*, 1*c*, and 1*d* serving as image bearing members, charging rollers 2*a*, 2*b*, 2*c*, and 2*d*, and cleaning blades 8*a*, 8*b*, 8*c*, and 8*d*.

Vertically below the process cartridges 3*a*, 3*b*, 3*c*, and 3*d*, there is arranged a scanner unit 9 which performs exposure based on an image signal on the photosensitive drums 1*a*, 1*b*, 1*c*, and 1*d*. The photosensitive drums 1*a*, 1*b*, 1*c*, and 1*d* are charged to a predetermined potential of negative polarity by the charging rollers 2*a*, 2*b*, 2*c*, and 2*d*, and then electrostatic latent images are formed respectively on the photosensitive drums by the scanner unit 9. The electrostatic latent images undergo reversal development by the development units 4*a*, 4*b*, 4*c*, and 4*d*, and toners of negative polarity are caused to adhere thereto, so that toner images of the colors of Y, M, C, and Bk are formed. In an intermediate transfer belt unit 10, an intermediate transfer belt 10*e* is stretched between a driving roller 10*f* and a tension roller 10*g*, and the tension roller 10*g* applies tension in a direction of an arrow T.

Primary transfer rollers 10*a*, 10*b*, 10*c*, and 10*d* are arranged so as to be situated on an inner side of the intermediate transfer belt 10*e* and to face the photosensitive drums 1*a*, 1*b*, 1*c*, and 1*d*, respectively. A transfer bias is applied to each of the primary transfer rollers by a bias application unit (not shown). The photosensitive drums rotate clockwise as shown in FIG. 1, and the intermediate transfer belt 10*e* rotates counterclockwise. By applying a bias of positive polarity to the primary transfer rollers 10*a*, 10*b*, 10*c*, and 10*d*, the toner images on the respective photosensitive drums successively undergo primary transfer onto the intermediate transfer belt 10*e*, and the toner images of the four colors are superimposed one upon the other and conveyed to a secondary transfer unit 13.

[Cleaning Unit]

After the transfer of the toner images, the toner remaining on the surfaces of the photosensitive drums 1*a*, 1*b*, 1*c*, and 1*d* is removed by cleaning blades 8*a*, 8*b*, 8*c*, and 8*d*. After the secondary transfer to a sheet, the toner remaining on the intermediate transfer belt 10*e* is removed by a transferring belt cleaning device 11. An image forming unit 18 is formed by the above described components.

[Secondary Transfer Unit and Fixing/Discharge Unit]

Sheets are separated one by one from a sheet bundle within a sheet feeding cassette 30 by a feeding roller 21 and a separation roller 22 of a sheet feeding apparatus 20 described below, and conveyed to the secondary transfer unit 13 via a registration roller pair 14. The secondary transfer unit 13 applies a bias of positive polarity to a secondary transfer roller 13*a*, so that the toner images of the four colors on the intermediate transfer belt 10*e* undergo secondary transfer onto the sheet conveyed. After the toner image transfer, the sheet is conveyed to a fixing unit 15 where the sheet undergoes heating and pressurization by a fixing roller 15*a* and a pressure roller 15*b*, thus the toner images are fixed onto the surface of the sheet. The sheet S that has undergone fixing is conveyed toward a discharge roller pair 16, and is discharged as it is onto a discharge tray 17.

[Sheet Feeding Apparatus]

Figure 2A:
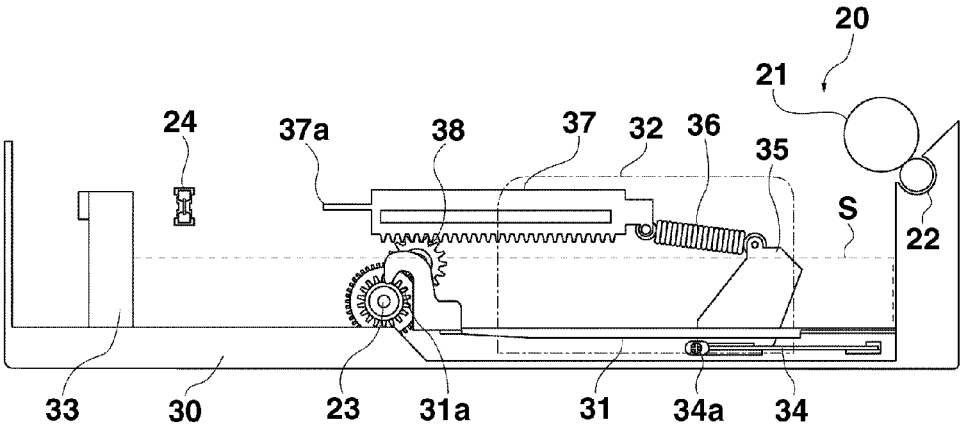
FIGS. 2A and 2B are sectional views illustrating a configuration of a sheet feeding apparatus according to a first exemplary embodiment of the present invention.
Figure 2B:
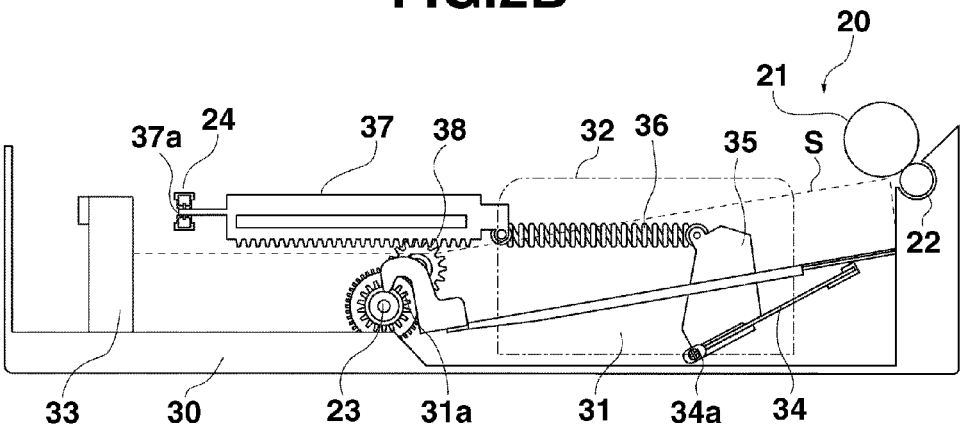

As shown in FIG. 1, the sheet feeding apparatus 20 of the first exemplary embodiment of the present invention is arranged in the lower portion of the image forming apparatus 100. The sheet feeding cassette 30 which is a sheet accommodating unit for accommodating sheets is formed to be detachable with respect to the image forming apparatus main body 100*a*. Further, the sheet feeding apparatus 20 is configured to feed stacked sheets one by one toward the image forming unit 18 installed thereabove. FIGS. 2A and 2B are sectional views illustrating the configuration of the sheet feeding apparatus.

The configuration of the sheet feeding apparatus 20 will be described in detail with reference to FIGS. 2A and 2B. FIG. 2A shows a state in which sheets are supported by the sheet feeding apparatus 20, and FIG. 2B shows a state in which the sheets have been raised from the state in FIG. 2A to enable sheet feeding.

A feeding roller 21 is fixed to the image forming apparatus main body 100*a*. A separation roller 22 is provided on the sheet feeding cassette 30. The feeding roller 21 and the separation roller 22 are arranged on a downstream side in a feeding direction of the sheets stacked in the sheet feeding cassette 30 and above the sheets, and are formed of an elastic material of high friction coefficient such as rubber. A driving motor (not shown) is connected to the feeding roller 21. The feeding roller 21 is held in press contact with the uppermost surface of the sheet bundle stacked on the sheet feeding cassette 30, and the driving motor is rotated in this state, and the sheets are fed toward the image forming unit 18.

The separation roller 22 is held in press contact with the feeding roller 21, and rotates around a shaft (not shown) provided on the sheet feeding cassette 30. A torque limiter (not shown) is provided between the separation roller 22 and the shaft. The torque limiter is set to torque such that, when one sheet is fed by the feeding roller 21, the separation roller 22 is rotated by the sheet. Further, the torque limiter is set to torque such that, when two sheets are fed by the feeding roller 21, the separation roller 22 is not rotated to prevent a sheet beneath the sheet in contact with the feeding roller 21 from being fed.

By thus constructing the feeding roller 21 and the separation roller 22, the sheets stacked in the sheet feeding cassette 30 can be fed reliably one by one toward the image forming unit 18.

A sheet stacking plate 31 serving as a sheet stacking unit raises a downstream portion in the feeding direction of the sheet bundle stacked on the sheet feeding cassette 30 toward the feeding roller 21 to bring the uppermost surface of the sheet bundle into press contact with the feeding roller 21. In the feeding direction, the sheet stacking plate 31 is situated between a trailing edge regulating member 33 described below and the feeding roller 21 so as to be rotatable around a rotation fulcrum 31*a* provided in the sheet feeding cassette 30. Thus, the downstream portion of the sheet stacking plate 31 can rise toward the feeding roller 21.

A side regulating member 32 regulates a position of the sheets stacked in the sheet feeding cassette 30 in a direction orthogonal to the feeding direction (width direction).

The side regulating member 32 is provided in the sheet feeding cassette 30, and is movable in the width direction with respect to the feeding direction. Further, the side regulating member 32 is formed so as to be movable independently to the sheet stacking plate 31 and capable of regulating the sheets in the width direction while maintaining the fixed state even when the sheet stacking plate 31 is moving.

The trailing edge regulating member 33 is arranged at an upstream portion in the feeding direction of the sheet feeding cassette 30, and regulates the position of an upstream end (trailing edge) of the sheets supported by the sheet stacking plate 31. The trailing edge regulating member 33 is provided in the sheet feeding cassette 30, and is movable in a direction parallel to the feeding direction.

Under the sheet stacking plate 31, there is arranged a push lever 34 for raising the sheet stacking plate 31 toward the feeding roller 21 while being in contact therewith. The push lever 34 is constructed such that the downstream portion in the feeding direction thereof is upwardly movable around a rotation fulcrum 34. A push arm 35 is provided at a position where the push arm 35 does not interfere with the stacked sheet bundle in the width direction of the sheet bundle stacked on the sheet feeding cassette 30. The push arm 35 is arranged so as to move integrally with the push lever 34. The push arm 35 is connected to a lifter rack 37 via a pressurization spring 36 constituting a pressurization unit.

The lifter rack 37 serving as a moving member is arranged so as to be capable of reciprocating with respect to the sheet feeding cassette 30 in a direction parallel to the feeding direction, and has a rack portion extending in the direction parallel to the feeding direction. At an end portion of the lifter rack 37, there is provided a flag portion 37*a* which shields a lifter rack position sensor 24, so that a position of the lifter rack 37 is detected.

A pinion gear (cassette gear) 38 is provided on the sheet feeding cassette 30 and in mesh with the rack portion of the lifter rack 37. A drive transmission gear 23 is provided on the image forming apparatus main body 100*a* side. When the sheet feeding cassette 30 is attached to the image forming apparatus main body, the pinion gear 38 is engaged with the drive transmission gear 23 provided on the image forming apparatus main body 100*a*. And, rotation of a lifting motor M1 (See FIG. 3) provided on the image forming apparatus main body 100*a* side is transmitted to the pinion gear 38 via the drive transmission gear 23. The drive transmission gear 23 and the pinion gear 38 constitute a drive mechanism according to the present invention for transmitting drive force from the lifting motor M1 to the lifter rack 37.

In the first exemplary embodiment, a lift unit is formed by the push lever 34, the push arm 35, the pressurization spring 36, the lifter rack 37, the pinion gear 38, the drive transmission gear 23, and the lifting motor M1.

An operation (lift-up operation) in which the sheet stacking plate 31 raises the downstream portion in the feeding direction of the sheet bundle to bring it into press contact with the feeding roller 21 is described.

As shown in FIG. 2A, when the sheet bundle is stacked in the sheet feeding cassette 30 and the sheet feeding cassette 30 is attached to the image forming apparatus main body 100*a*, the lifting motor M1 rotates, and the pinion gear 38 is rotated via the drive transmission gear 23. And, by the rotation of the pinion gear 38, the lifter rack 37 moves along the feeding direction. When the lifter rack 37 moves along the feeding direction, the push lever 34 is moved upward via the pressurization spring 36 and the push arm 35. Further, by the upward movement of the push lever 34, the sheet stacking plate 31 is raised toward the feeding roller 21 while supporting the sheet bundle. Since the push lever 34 is moved via the pressurization spring 36, the tensile force of the pressurization spring 36 is transmitted to the push lever 34.

Then, the uppermost surface of the sheet bundle is brought into press contact with the feeding roller 21 and the lifting motor M1 stops at a position where the flag portion 37*a* of the lifter rack 37 blocks light of the lifter rack position sensor 24 as shown in FIG. 2B. Due to retaining force of the lifting motor M1, the sheet bundle is maintained in the state in which it is held in press contact with the feeding roller 21 as shown in FIG. 2B. At this time, the pressurization spring 36 provides sheet feeding pressure to the portion between the feeding roller 21 and the sheet bundle via the sheet stacking plate 31.

When the sheet feeding cassette 30 is detached from the image forming apparatus main body 100*a* in the state of FIG. 2B, the retaining force of the lifting motor M1 is released, so that the sheet stacking plate 31 moves downward due to its own weight. As a result, the sheet feeding cassette 30 is placed in a state in which a user can easily supply the sheet bundle.

[Block Diagram]

Next, a configuration of a controller for controlling the image forming apparatus will be described with reference to FIG. 3.

Figure 3:
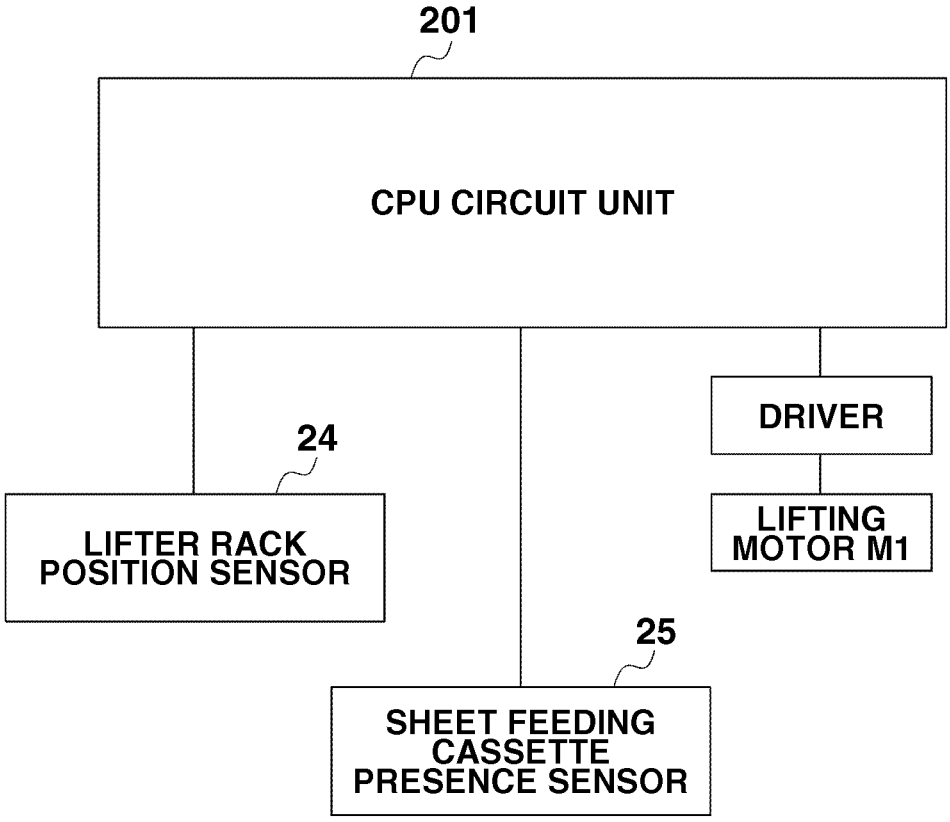
FIG. 3 is a block diagram illustrating an image forming apparatus equipped with the sheet feeding apparatus of the first exemplary embodiment of the present invention.

FIG. 3 is a block diagram illustrating the configuration of the controller for controlling the image forming apparatus in FIG. 1. As shown in FIG. 3, the controller includes a central processing unit (CPU) circuit unit 201 which is a control unit.

The CPU circuit unit 201 is connected to the lifter rack position sensor 24 and a sheet feeding cassette presence sensor 25, and can obtain a detection result of each sensor. Further, the CPU circuit unit 201 is connected to the lifting motor M1 via a driver to control driving of the lifting motor M1. The CPU circuit unit 201, the lifter rack position sensor 24, and the lifting motor M1 constitute a vibration providing unit which provides vibration to the sheet stacking plate 31 and the sheets thereon.

[Control of the Sheet Stacking Plate 31]

Figure 4A:
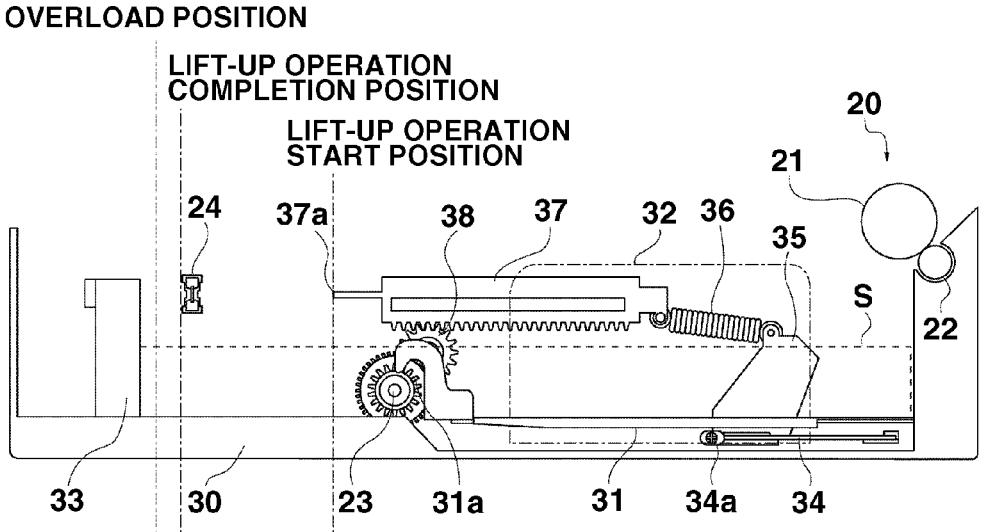
FIGS. 4A through 4C are schematic diagrams illustrating a lift-up operation of the sheet feeding apparatus of the first exemplary embodiment of the present invention.

The control of the sheet stacking plate 31 according to the present invention will be described with reference to FIGS. 4A through 4C. FIG. 4A shows the sheet stacking plate 31 in a state before a lift-up operation.

When the sheet feeding cassette 30 is attached to the image forming apparatus main body 100*a*, and the sheet feeding cassette presence sensor 25 detects its presence, the CPU circuit unit 201 rotates the lifting motor M1 from the state illustrated in FIG. 4A. According to the rotation of the lifting motor M1, the lifter rack 37 is moved along the feeding direction via the drive transmission gear 23 and the pinion gear 38. As the lifter rack 37 moves, the push lever 34 moves upwardly via the pressurization spring 36 and the push arm 35. The upward movement of the push lever 34 causes the sheet stacking plate 31 to raise the downstream portion in the feeding direction of the sheet bundle.

Even after the flag portion 37*a* of the lifter flag 37 blocks the light of the lifter rack position sensor 24 and reaches a lift-up operation completion position which travels a predetermined distance upstream in the feeding direction, the CPU circuit unit 201 rotates the lifting motor M1, and causes the lifter rack 37 to continue to move. The lift-up operation completion position is a position for providing proper sheet feeding pressure to feed the sheets one by one toward the image forming unit 18 by the feeding roller 21 and the separation roller 22 (first position). The lift-up operation completion position is set by the position of the flag position 37*a* of the lifter rack 37.

A conventional sheet feeding unit stops the operation of the lifter rack 37 to stop the sheet stacking plate when the flag portion 37*a* reaches the lift-up operation completion position. Thus, as described above, when the sheet stacking plate 31 is stopped, the sheet feeding pressure may be reduced due to the sliding resistance generated when the sheet bundle end surface gets caught by the surface of the side regulating member.

To mitigate the reduction in the sheet feeding pressure, the CPU circuit unit 201 controls the following operation.

Figure 4B:
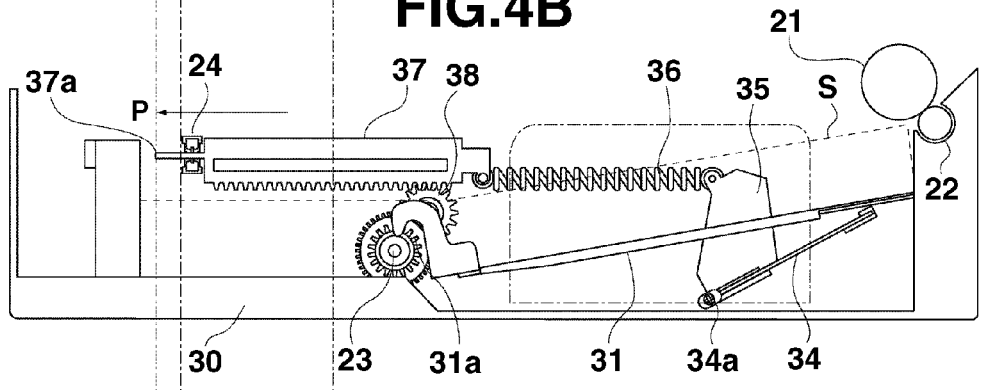

Even after the lift-up operation completion position has been reached, the CPU circuit unit 201 continues the movement of the lifter rack 37, and, as shown in FIG. 4B, moves the flag portion 37*a* to an overload position (second position). If the lifting motor M1 is a pulse motor, the lifting motor M1 rotates by a predetermined number of pulses to move the flag portion 37*a* to the overload position. If it is a direct current (DC) motor, the lifting motor M1 continues to rotate for a predetermined period of time to move the flag portion 37*a* to the overload position. Through such operation, the sheet feeding pressure is increased as compared with the case where the flag portion 37*a* stops at the lift-up operation completion position.

In the present exemplary embodiment, the lift-up operation completion position and the overload position are set based on detection results of the lifter rack position sensor 24. However, it is also possible to separately provide a sensor, and set the overload position based on a detection result of that sensor.

Figure 4C:
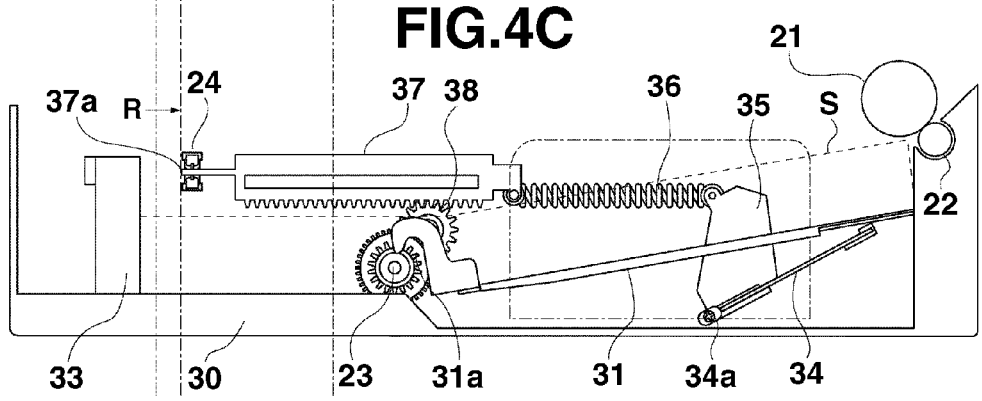

After moving the flag portion 37*a* to the overload position, the CPU circuit unit 201 causes the lifting motor M1 to rotate reversely to move the flag portion 37*a* to the lift-up operation completion position as shown in FIG. 4C. Through this operation, the sheet feeding pressure is reduced from that when the flag portion 37*a* is positioned at the overload position to a proper level.

As described above, after the lift-up operation has been started, the flag portion 37*a* passing through the lift-up operation completion position is moved to the overload position and is moved again to the lift-up operation completion position, accordingly the sheet feeding pressure increases, and then decreases. By thus varying the sheet feeding pressure, the sheet stacking plate 31 and the sheet bundle on the sheet stacking plate 31 are vibrated due to vibration of the components, flexure of the components, play in the components, etc. The vibration of the sheet stacking plate 31 and the sheet bundle thereon can release a caught state caused between the sheet bundle end surface and the surface of the side regulating member 32, and reduce the sliding resistance due to the caught state.

Figure 11:
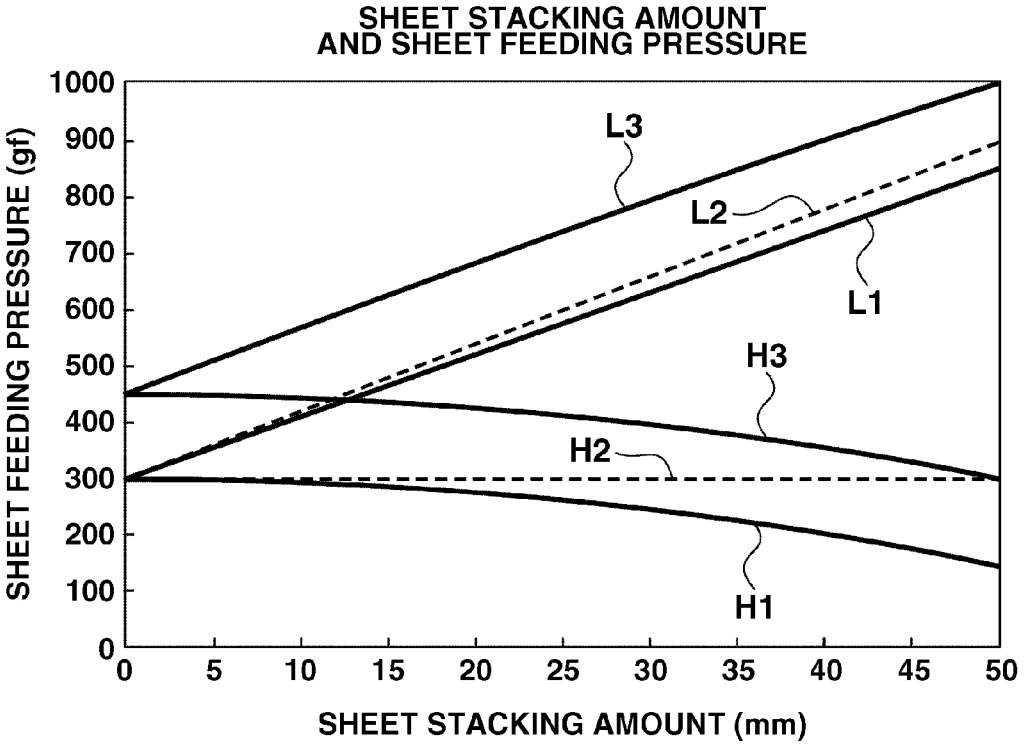
FIG. 11 is a graph illustrating a relationship between a sheet stacking amount and sheet feeding pressure.

Accordingly, it is possible to lead the state indicated by the lines H2 and L2 of the graph in FIG. 11 in which the reduction in the sheet feeding pressure is not included, from the state indicated by the lines H1 and L1 in which the reduction in the sheet feeding pressure is included. By thus mitigating the reduction in the sheet feeding pressure, the sheet feeding apparatus according to the present exemplary embodiment can execute a stable sheet feeding.

In the first exemplary embodiment, when the sheet feeding cassette 30 is attached to the image forming apparatus main body 100*a* and the sheet feeding cassette presence sensor 25 detects the presence of the sheet feeding cassette, the above described lift-up operation is performed. However, it is also possible to perform the lift-up operation when the sheet stacking plate 31 is lowered to perform sheet feeding operation again.

Further, before performing the sheet feeding operation, the flag portion 37*a* may be moved from the lift-up operation complete position to the overload position, and then be moved to the lift-up operation complete position.

Figure 5:
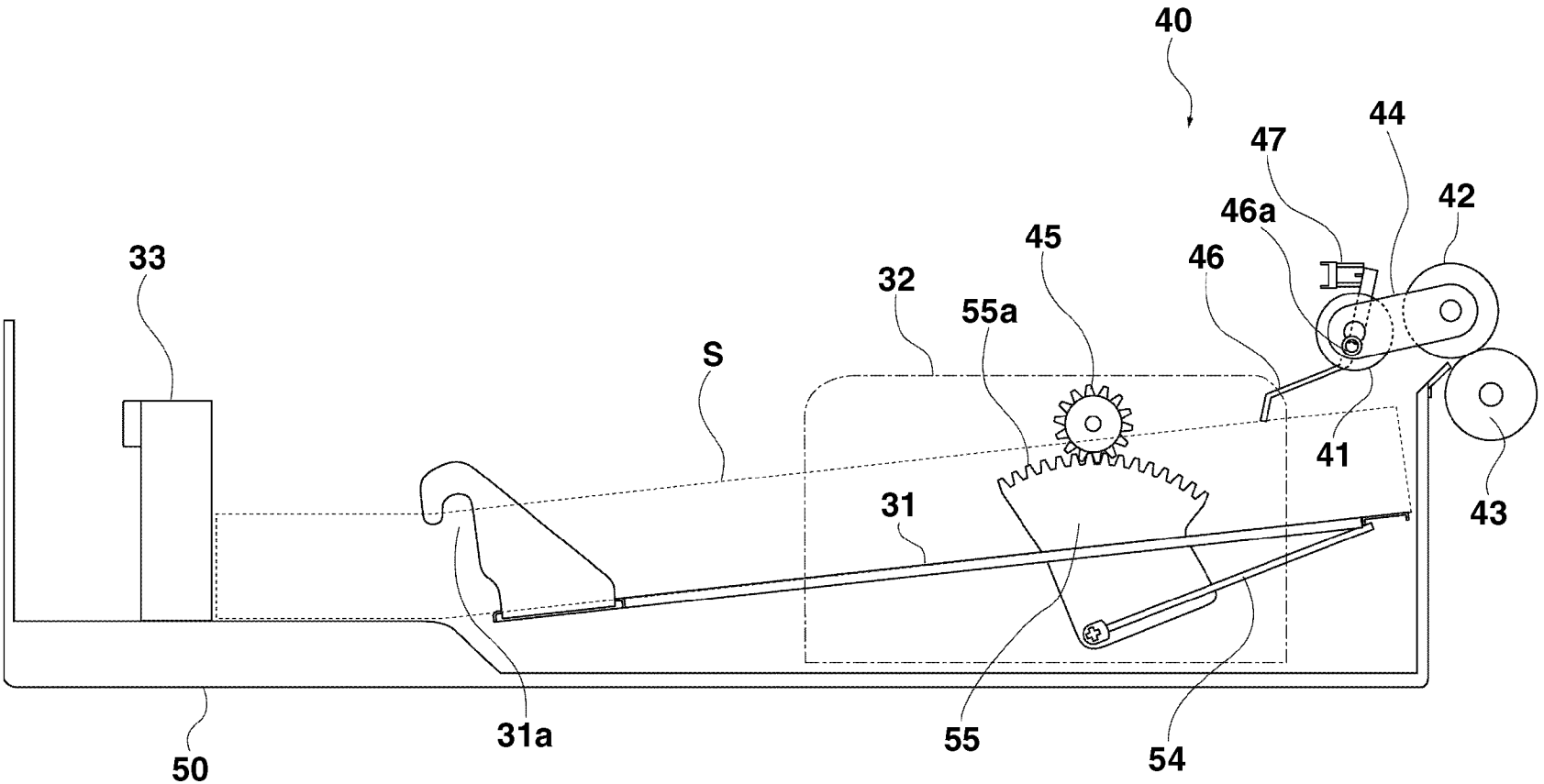
FIG. 5 is a sectional view illustrating a configuration of a sheet feeding apparatus according to a second exemplary embodiment of the present invention.

Next, a second exemplary embodiment will be described with reference to FIG. 5. The similar components and the components having the similar functions as those of the first exemplary embodiment are denoted by the same reference numerals, and descriptions thereof will be omitted.

In the second exemplary embodiment described below, the lift-up operation of the first exemplary embodiment is applied to another lift unit and another sheet feeding mechanism. FIG. 5 is a sectional view illustrating the configuration of a sheet feeding apparatus according to the second exemplary embodiment.

A sheet feeding apparatus 40 according to the second exemplary embodiment adopts a retard separation system which includes a feeding roller 41 and a separation roller pair formed by a feed roller 42 and a retard roller 43.

The feeding roller 41 is rotatably supported on the shaft of the feed roller 42 by a roller holder 44, and can ascend and descend. By a descending movement, the feeding roller 41 applies a predetermined press contact force (sheet feeding pressure) to the uppermost surface of the sheets S on the sheet stacking plate 31, and rotates in this state to perform sheet feeding operation.

The feed roller 42 rotates so as to be capable of performing sheet conveyance in the same direction as the feeding direction of the feeding roller 41. Driving force for rotation in a direction opposite to the feeding direction of the feeding roller 41 is provided to the retard roller 43 via a torque limiter (not shown). The feed roller 42 and the retard roller 43 are in press contact with each other to form a nip portion.

When there is no sheet at the nip portion and when there is one sheet at the nip portion, the retard roller 43 rotates to convey the sheet in the same direction as the feeding direction of the feeding roller 41 due to the action of the torque limiter. When there are two sheets at the nip portion, the retard roller 43 rotates to convey the sheet in a direction opposite to the feeding direction of the feeding roller 41.

According to such configuration of the feed roller 42 and the retard roller 43, a single sheet is reliably separated by the feed roller 42 and the retard roller 43 from the sheets S conveyed by the rotation of the feeding roller 41, and is then conveyed downstream.

In the sheet feeding apparatus 40 provided with the sheet stacking plate 31 serving as the sheet stacking unit, the uppermost surface of the sheets S on the sheet stacking plate 31 is raised to a predetermined height by a lift-up operation described below, and then the sheet feeding roller 41 is lowered to the uppermost surface of the sheets S by an actuator (not shown).

Unlike the first exemplary embodiment, in the second exemplary embodiment, the sheet feeding pressure is generated by bringing the feeding roller 41 into press contact with the sheet bundle by the descending movement. However, if the sliding resistance between the sheet bundle end surface and the side regulating member 32 is large, the sliding resistance may be turned into a conveyance resistance in the sheet feeding operation of the feeding roller 41, and there is a fear of feeding failure occurring. Therefore, also in this configuration, it is necessary to reduce the sliding resistance between the sheet bundle end surface and the side regulating member 32.

A lift lever 54 corresponds to the push lever 34 of the first exemplary embodiment, and is installed in order to raise the sheet stacking plate 31 from below. A lift arm 55 corresponds to the push arm 35 of the first exemplary embodiment. The lift arm 55 is provided at a position where the lift arm 55 does not interfere with the stacked sheet bundle in the width direction of the sheet bundle stacked on the sheet feeding cassette 30, and is arranged so as to move integrally with the lift lever 54.

The lift arm 55 is provided with a gear portion 55*a*. When the sheet feeding cassette 50 is attached to the image forming apparatus main body 100*a*, the gear portion 55*a* is engaged with a drive transmission gear 45 arranged on the image forming apparatus main body 100*a*. When the sheet feeding cassette 50 is separated from the image forming apparatus main body 100*a*, the gear portion 55*a* of the lift arm 55 is spaced apart from the drive transmission gear 45. The drive transmission gear 45 is engaged with a lifting motor M2 (See FIG. 6) arranged in the image forming apparatus main body 100*a*, and the rotation of the lifting motor M2 is transmitted to the gear portion 55*a* via the drive transmission gear 45.

In the second exemplary embodiment, the lift unit is formed by the lift lever 54, the lift arm 55, the drive transmission gear 54, and the lifting motor M2.

A paper surface detection flag 46 is arranged above a downstream end portion in the feeding direction of the sheet bundle stacked in the sheet feeding cassette 50 and abuts on the uppermost surface of the sheets S on the sheet stacking plate 31. The paper surface detection flag 46 is supported so as to be rotatable around a rotation fulcrum 46*a*. A sheet surface detection sensor 47 detects the position of the uppermost surface of the sheets S by detecting light is blocked by the sheet surface detection flag 46 or transmitted.

Figure 6:
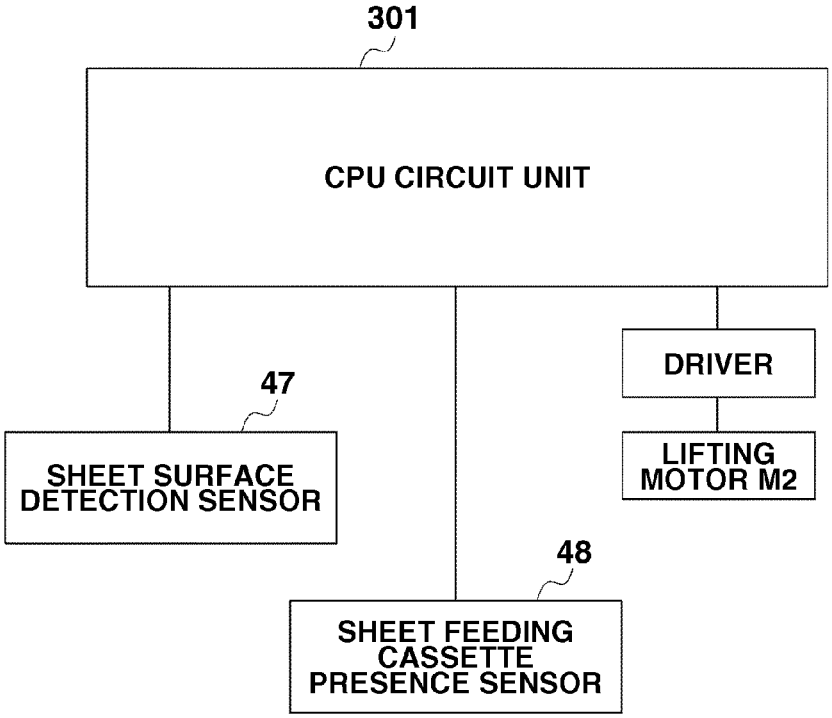
FIG. 6 is a block diagram of an image forming apparatus equipped with the sheet feeding apparatus of the second exemplary embodiment of the present invention.

Next, a configuration of a controller for controlling the image forming apparatus according to the present exemplary embodiment will be described with reference to FIG. 6. FIG. 6 is a block diagram showing the configuration of the controller according to the second exemplary embodiment for controlling the image forming apparatus of FIG. 1. As shown in FIG. 6, the controller includes a CPU circuit unit 301 which is a control unit.

The CPU circuit unit 301 is connected to the sheet surface detection sensor 47 and a sheet feeding cassette presence sensor 48, and can obtain a detection result of each sensor. Further, the CPU circuit unit 301 is connected to the lifting motor M2 via a driver to control the driving of the lifting motor M2.

A conventional sheet feeding unit starts a lift-up operation and stops the lifting motor M2 based on the detection result of the sheet surface detection sensor to stop the sheet stacking plate 31. The stop position of the sheet stacking plate 31 corresponds to the lift-up operation completion state. When the feeding roller 41 descends and abuts on the upper surface of the sheet bundle, a predetermined (proper) sheet feeding pressure is provided.

As described above, in this configuration, when the sheet stacking plate 31 is stopped, there may be generated a conveyance resistance in the sheet feeding operation of the feeding roller 41 due to the sliding resistance generated when the sheet bundle end surface gets caught by the surface of the side regulating member.

To reduce the conveyance resistance, the CPU circuit unit 301 performs the following operation.

Figure 7A:
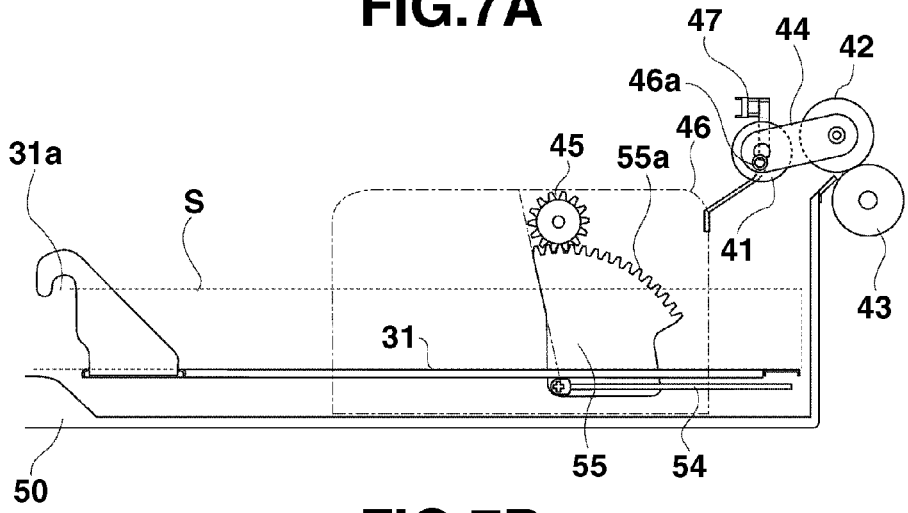
FIGS. 7A through 7C are schematic diagrams illustrating a lift-up operation of the sheet feeding apparatus of the second exemplary embodiment of the present invention.
Figure 7B:
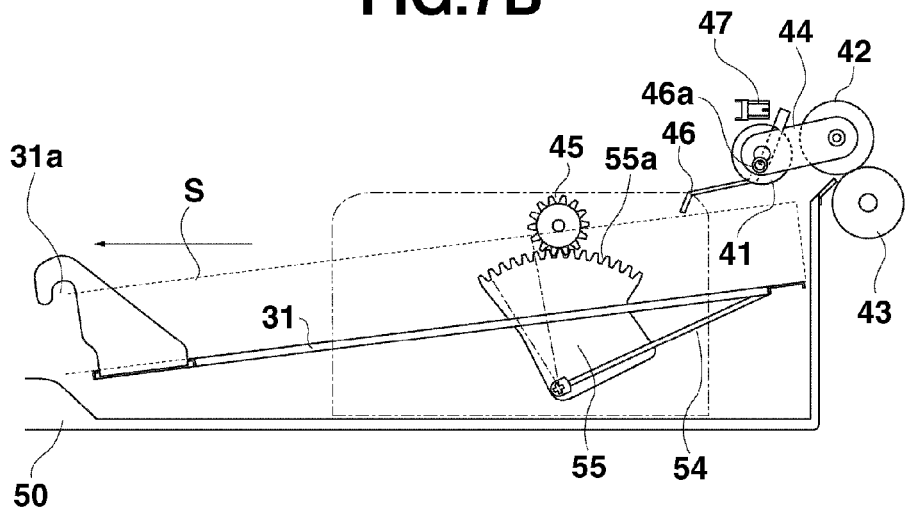
Figure 7C:
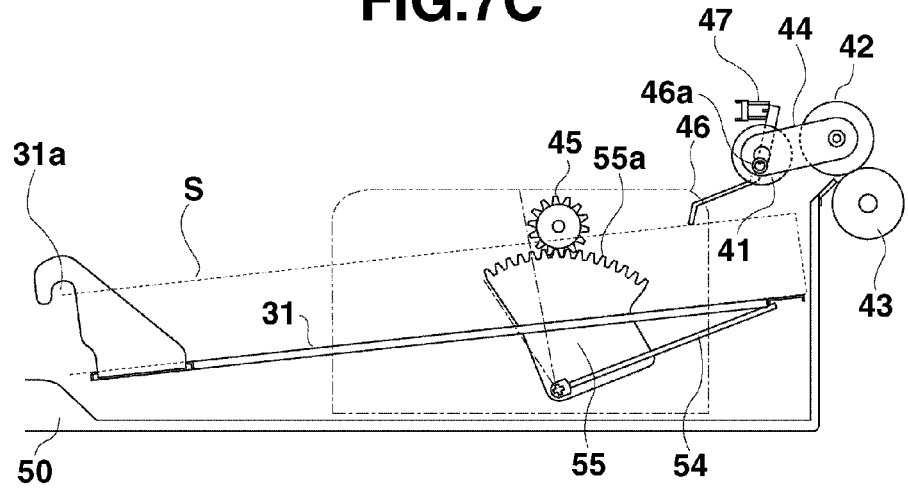

FIGS. 7A through 7C are schematic diagrams illustrating the lift-up operation according to the second exemplary embodiment. FIG. 7A shows a state before the start of the lift-up operation, and FIG. 7C shows a lift-up operation completion state. FIG. 7B shows a state in which the sheet bundle is raised higher than in the lift-up operation completion state in FIG. 7C. The lift-up operation completion state is a state in which the uppermost surface of the sheets S on the sheet stacking plate 31 is at a position where sheet feeding by the feeding roller 31 is performed.

When the sheet feeding cassette 50 is attached to the image forming apparatus main body 100*a* and the sheet feeding cassette presence sensor 48 detects the sheet feeding cassette 50, the CPU circuit unit 301 rotates the lifting motor M2, and rotates the lift lever 54 upward via the drive transmission gear 45 and the gear portion 55*a*. Further, by the rotation of the lifting motor M2, the sheet stacking plate 31 is raised via the lift lever 54. And, the uppermost surface of the sheets S on the sheet stacking plate 31 reaches a leading edge of the sheet surface detection flag 46, and raises the sheet surface detection flag 46 while causing it to rotate around the rotation fulcrum 46*a*.

When the sheet surface detection flag 46 passes through the sheet surface detection sensor 47 from the state in which the sheet surface detection flag 46 blocks the light of the sheet surface detection sensor 47, and rotates by a predetermined amount while being raised by the sheets, the CPU circuit unit 301 stops the lifting motor M2. In other words, as shown in FIG. 7B, the CPU circuit unit 301 raises the sheet stacking plate 31 such that the uppermost surface of the sheets S on the sheet stacking plate 31 is situated still higher than in the lift-up operation completion state.

If the lifting motor M2 is a pulse motor, after the sheet surface detection flag 46 passes through the sheet surface detection sensor 47, the lifting motor M2 rotates by a predetermined number of pulses to move the uppermost surface of the sheets S at a position still higher than in the lift-up operation completion state. In the case of a DC motor, after the sheet surface detection flag 46 passes through the sheet surface detection sensor 47, the lifting motor M2 continues to rotate for a predetermined period of time, so that the uppermost surface of the sheets S is situated still higher than in the lift-up operation completion state.

Then, the CPU circuit unit 301 causes the lifting motor M2 to rotate reversely, and lowers the lift lever 54 by a predetermined amount via the drive transmission gear 45 and the gear portion 55*a*. Then, the CPU circuit unit 301 moves the uppermost surface of the sheets S on the sheet stacking plate 31 to the lift-up operation completion position shown in FIG. 7C and stops the lifting motor M2. Accordingly, the lift-up operation is completed. At the time of lift-up operation completion, the sheet surface detection flag 46 stops at a position not to block the light of the sheet surface detection sensor 47. In addition, due to the retaining force of the lifting motor M2, the sheet bundle is maintained in the state shown in FIG. 7C. The above described operation is the lift-up operation in the second exemplary embodiment.

After the above described lift-up operation, the feeding operation by the feeding roller 41 is performed. However, when the feeding operation is continued, the uppermost position of the sheets S becomes lower, and the sheet surface detection flag 46 rotates downward to block the light of the sheet surface detection sensor 47. In such situation, the CPU circuit unit 301 operates the lifting motor M2, and moves the uppermost surface of the sheets S to the position in the lift-up operation completion state in which the sheet surface detection flag 46 does not block the light of the sheet surface detection sensor 47.

In the state in FIG. 7C, when the sheet feeding cassette 50 is detached from the image forming apparatus main body 100*a*, the retaining force of the lifting motor M2 is released, so that the sheet stacking plate 31 moves downward due to its own weight. As a result, the sheet feeding cassette 50 is placed in a state in which a user can easily supply the sheet bundle.

The CPU circuit unit 301 causes the sheet stacking plate 31 to move reciprocatively. That is, the sheet stacking plate 31 is caused to once pass through the lift-up completion position, to move upwardly by a predetermined amount, and then to return to the lift-up completion position. Through the reciprocating operation, the end surface of the sheets S which has been caught by the side regulating member 32 is released from the caught state when the sheet stacking plate 31 moves up and then down.

Figure 10:
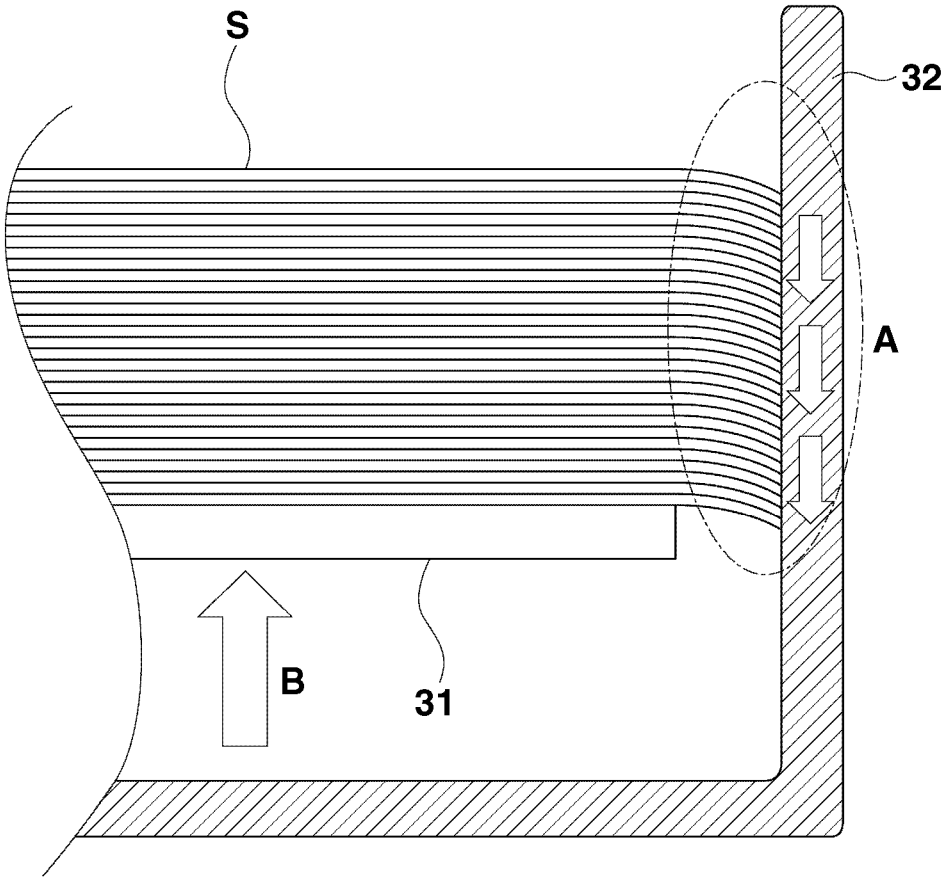
FIG. 10 is a schematic diagram illustrating a sliding resistance between sheets and a side regulating member.

Accordingly, the sliding resistance due to the caught state between the end surface of the sheets S and the side regulating member 32 as shown in FIG. 10 is reduced, and the conveyance resistance in the sheet feeding operation by the feeding roller 41 decreases. In this way, by starting the feeding operation after the completion of the lift-up operation described above, the sheet feeding apparatus according to the present exemplary embodiment can execute a stable feeding.

In the second exemplary embodiment, when the sheet feeding cassette 50 is attached to the image forming apparatus main body 100*a* and the sheet feeding cassette presence sensor 48 detects the sheet feeding cassette 50, the above described lift-up operation is performed. However, it is also possible to perform the lift-up operation when the sheet stacking plate 31 is lowered to perform sheet feeding operation again. Further, before performing sheet feeding operation, the sheets may be raised from the lift-up operation completion state, and then be shifted to the lift-up operation completion state.

Further, in the second exemplary embodiment, to cancel the caught state between the end surface of the sheets S and the side regulating member 32, it is also possible to control the sheet stacking plate 31 as follows.

The CPU circuit unit 301 rotates the lifting motor M2, and upwardly rotates the lift lever 54 via the drive transmission gear 45 and the gear portion 55*a*. Further, by the rotation of the lifting motor M2, the sheet stacking plate 31 is raised via the lift lever 54. And, the uppermost surface of the sheets S on the sheet stacking plate 31 reaches the leading edge of the sheet surface detection flag 46, and raises the sheet surface detection flag 46 while causing it to rotate around the rotation fulcrum 46*a*.

When the sheet surface detection flag 46 passes through the sheet surface detection sensor 47 from the state in which the sheet surface detection flag 46 blocks the light of the sheet surface detection sensor 47, and rotates by a predetermined amount while being raised by the sheets, the CPU circuit unit 301 causes the lifting motor M2 to rotate reversely to lower the sheets by a predetermined amount. Then, the CPU circuit unit 301 raises again and moves the sheets to the lift-up completion position shown in FIG. 7C, and stops the lifting motor M2. Through this control, it is possible to release the caught state between the end surface of the sheets S and the side regulating member 32.

Figure 8:
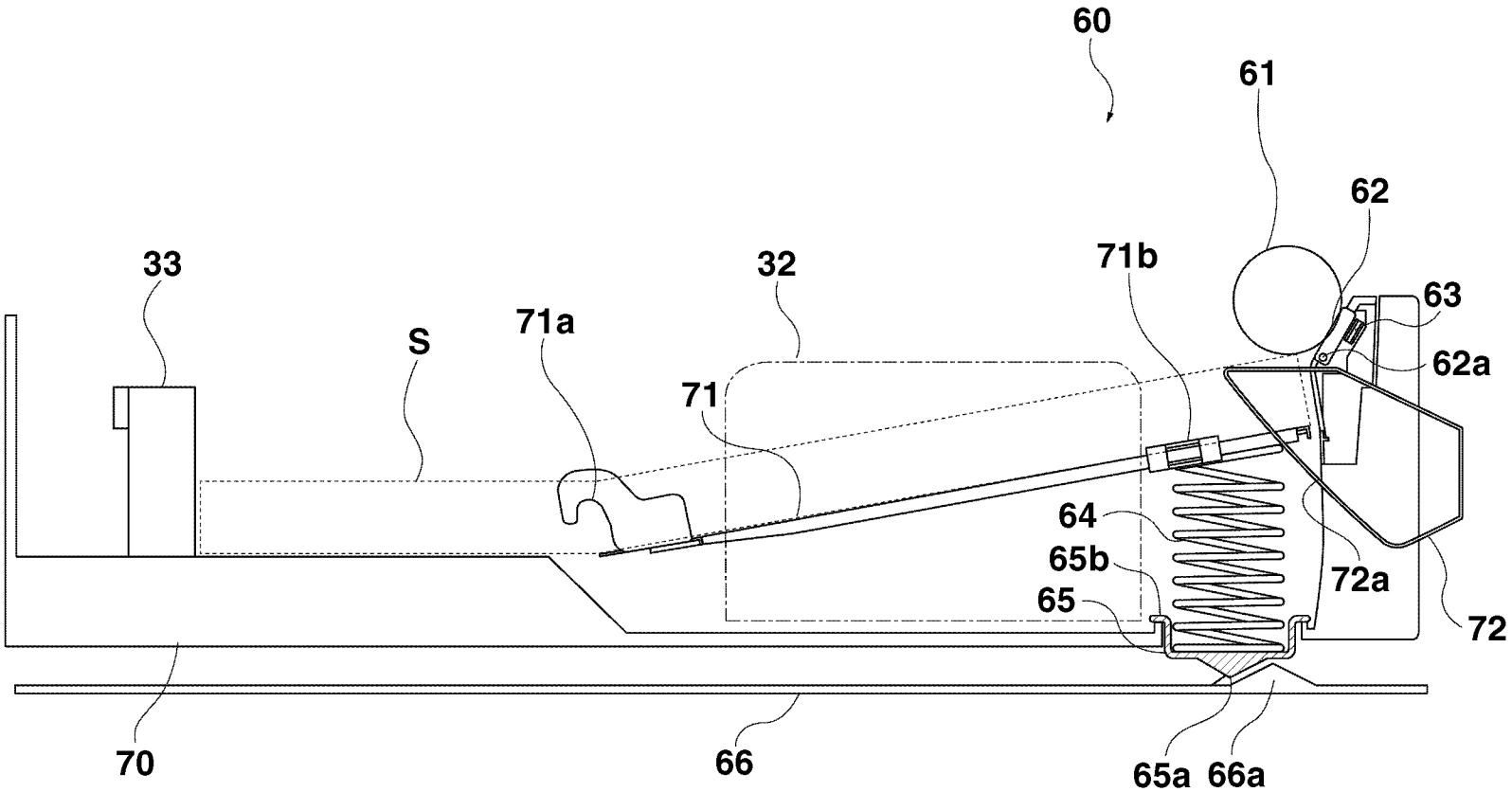
FIG. 8 is a sectional view illustrating a configuration of a sheet feeding apparatus according to a third exemplary embodiment of the present invention.

Next, a third exemplary embodiment will be described with reference to the drawings. The similar components and the components having the similar functions as those of the first and second exemplary embodiments are denoted by the same reference numerals, and descriptions thereof will be omitted. FIG. 8 is a sectional view illustrating the configuration of a sheet feeding apparatus according to the third exemplary embodiment.

A sheet feeding apparatus 60 according to the third exemplary embodiment is a pad separation type sheet feeding apparatus equipped with a feeding roller 61 and a separation pad 62 as a separation unit. The separation pad 62 is rotatably supported by a rotation fulcrum 62*a*, and is held in press contact with the feeding roller 61 by a separation pad spring 63. The sheets S on a sheet stacking plate 71 are separated one by one by the feeding roller 61 and the separation pad 62 and fed downstream.

The lift-up operation in the third exemplary embodiment is conducted simply in synchronization with the attachment and detachment of a sheet feeding cassette 70. The sheet feeding cassette 70 is slidable in the horizontal direction as shown in FIG. 8 (a direction parallel to the feeding direction), and detachable with respect to the image forming apparatus main body 100*a*. Under the sheet stacking plate 71 in the sheet feeding cassette 70, there is arranged a compression spring 64 constituting a pressurization unit. One end of the compression spring 64 is held in contact with an abutment portion 71*b* on the bottom surface of the sheet stacking plate 71 and applies pressure to the sheet stacking plate 71 upwardly. At the other end of the compression spring 64, there is arranged a spring seat member 65 which is a moving member for receiving the reaction force of the compression spring 64. The spring seat member 65 is arranged so as to be vertically slidable along a hole formed at the bottom of the sheet feeding cassette 70.

A cam member 72 provided in the image forming apparatus main body 100*a* regulates the lift-up movement of the sheet stacking plate 71 at the time of attachment and detachment of the sheet feeding cassette 70. When the sheet feeding cassette 70 is detached from the image forming apparatus main body 100*a*, the abutment portion 71*b* of the sheet stacking plate 71, which is urged upward, and a cam surface 72*a* are brought into contact with each other, so that the cam member 72 regulates the height of the sheet stacking plate 71 according to the position of the sheet feeding cassette 70. A guide member 66 has a guide surface arranged on the bottom surface of an accommodating portion of the sheet feeding cassette 70 of the image forming apparatus main body 100*a* and a protrusion piece 66*a*.

The protrusion piece 66*a* is situated in a phase relation such that a protrusion portion 65*a* provided on the spring seat member 65 to climbs the protrusion piece 66*a* at the time of attachment and detachment of the sheet feeding cassette 70. Further, the protrusion piece 66*a* has an inclined surface so that the protrusion portion 65*a* of the spring seat member 65*a* can smoothly climb it. Although in the present exemplary embodiment, an inclined surface is also provided on the protrusion portion 65*a* of the spring seat member 65, it is also possible to provide an inclined surface one of the protrusion piece 66*a* and the protrusion portion 65*a*. The spring seat member 65 is provided with a detachment prevention portion 65*b* so that the spring seat member 65 may not be detached from the sheet feeding cassette 70 to the exterior due to the force of the compression spring 64.

In the third exemplary embodiment, the lift unit is formed by the compression spring 64, the spring seat member 65, and the protrusion piece 66*a*. The lift unit serves as a vibration providing unit for providing vibration to the sheet stacking plate 71 and the sheets thereon.

Figure 9A:
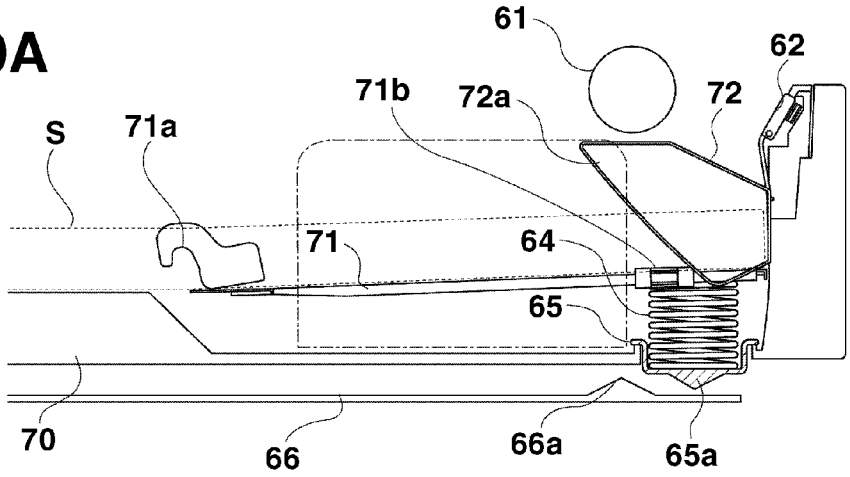
FIGS. 9A through 9C are schematic diagrams illustrating a lift-up operation of the sheet feeding apparatus of the third exemplary embodiment of the present invention.
Figure 9B:
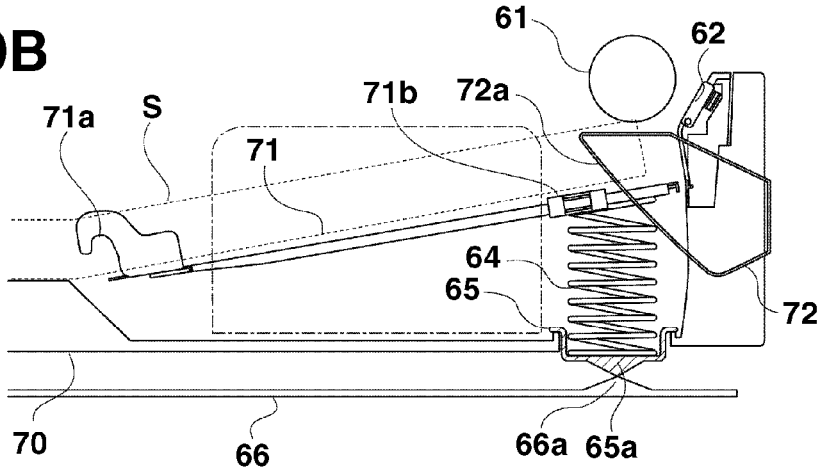
Figure 9C:
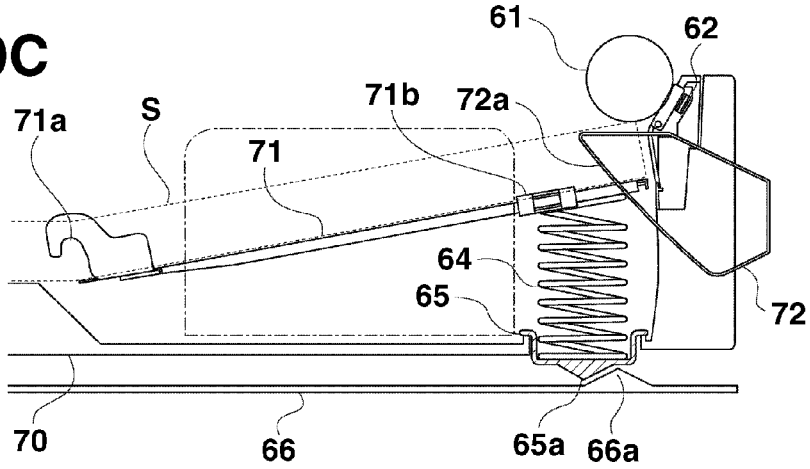

FIGS. 9A through 9C are schematic diagrams illustrating the lift-up operation according to the third exemplary embodiment. The sheet feeding cassette 70 is attached to the left (in the upstream direction with respect to the feeding direction) as shown in the drawings. FIG. 9A shows a state before the start of the lift-up operation, and FIG. 9*c* shows the lift-up operation completion state. FIG. 9B shows the state during the lift-up operation.

FIG. 9A shows the state in which the sheet stacking plate 71 is upwardly urged by the compression spring 64, the cam surface 72*a* of the cam member 72 abuts the abutment portion 71*b* of the sheet stacking plate 71, and the sheet feeding cassette 70 is inserted to the left as shown in the drawing while regulating the height of the sheet stacking plate 71. At this time, the spring seat member 65 is held in contact with the guide surface of the guide member 66. The cam surface 72*a* of the cam member 72 is configured such that the sheet stacking plate 71 is raised higher as an attachment operation of the sheet feeding cassette 70 proceeds (as the sheet feeding cassette 70 advances to the left).

Further, the sheet feeding cassette 70 advances to the left, and the uppermost sheet of the sheets S on the sheet stacking plate 71 abuts on the feeding roller 61. After this, the abutment portion 71*b* of the sheet stacking plate 71 moves away from the cam member 72, and the height of the sheet stacking plate 71 is regulated by the feeding roller 61 via the sheets S. And, after the movement of the sheet stacking plate 71 is regulated, the protrusion portion 65*a* of the spring seat member 65 abuts on the protrusion piece 66*a* of the guide member 66, and the spring seat member 65 moves to get over the protrusion piece 66*a* while upwardly sliding.

FIG. 9B shows the state (second position) in which the protrusion portion 65*a* of the spring seat member 65 is on the protrusion piece 66*a* of the guide member 66. In the state illustrated in FIG. 9B, the spring seat member 65 has upwardly slid, so that a working length of the compression spring 64 is shorter by the sliding amount, accordingly the pressure applied to the sheet stacking plate 71 increases. When the sheet feeding cassette 70 moves to the left, the feeding roller 61 and the separation pad 62 abut each other as shown in FIG. 9C.

At this time, the protrusion portion 65*a* of the spring seat member 65 gets over the protrusion piece 66*a* of the guide member 66, and the spring seat member 65 is in the state (first position) in which it abuts on the guide surface of the guide member 66. In other words, the working length of the compression spring 64 is longer than in the state in FIG. 9B, so that the pressure applied to the sheet stacking plate 71 is reduced. Through the above operation, the lift-up operation in synchronization with the attachment of the sheet feeding cassette 70 is completed.

In the third exemplary embodiment described above, the spring seat member 65 of the compression spring 64 which applies pressure to the sheet stacking plate 71 is caused to slide reciprocatively in synchronization with the attachment of the sheet feeding cassette 70, so that the pressure applied to the sheet stacking plate 71 can be increased and decreased. Accordingly, a vibration due to the pressurization and depressurization of the compression spring 64 is applied to the sheet stacking plate 71. Then, the stacking plate 71 and the sheet bundle on the sheet stacking plate 71 vibrate to reduce the sliding resistance due to the caught state generated between the sheet bundle end surface and the surface of the side regulating member.

Accordingly, it is possible to lead the state indicated by the lines H2 and L2 of the graph in FIG. 11 in which the reduction in the sheet feeding pressure is not included, from the state indicated by the lines H1 and L1 in which the reduction in the sheet feeding pressure is included. By thus mitigating the reduction in the sheet feeding pressure, the sheet feeding apparatus according to the present exemplary embodiment can execute a stable sheet feeding.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet feeding apparatus comprising:

a sheet accommodating unit which is detachably attached to an apparatus main body and configured to accommodate sheets;

a sheet stacking unit which is provided in the sheet accommodating unit and can move while supporting the sheet;

a sheet feeding unit configured to feed the sheet stacked on the sheet stacking unit;

a lift unit configured to move the sheet stacking unit toward the sheet feeding unit, the lift unit including a pulse motor to raise the sheet stacking unit;

a detection unit configured to detect a position of an uppermost surface of the sheet stacked on the sheet stacking unit, and a controller configured to control the lift unit so as to move the sheet stacking unit to a lift-up position, based on a detection result of the detection unit, at which the sheet feeding unit feeds the sheet stacked on the sheet stacking unit, wherein, before feeding of the sheet stacked on the sheet stacking unit by the sheet feeding unit, the controller controls the pulse motor so as to rotate by a predetermined number of pulses to raise the sheet stacking unit higher than the lift-up position and then controls the pulse motor so as to rotate reversely to lowers the sheet stacking unit to the lift-up position.

2. The sheet feeding apparatus comprising:

a sheet accommodating unit which is detachably attached to an apparatus main body and configured to accommodate sheets;

a sheet stacking unit which is provided in the sheet accommodating unit and can move while supporting the sheet;

a sheet feeding unit configured to feed the sheet stacked on the sheet stacking unit;

a lift unit configured to move the sheet stacking unit toward the sheet feeding unit, the lift unit including a DC motor to raise the sheet stacking unit;

a detection unit configured to detect a position of an uppermost surface of the sheet stacked on the sheet stacking unit, and a controller configured to control the lift unit so as to move the sheet stacking unit to a lift-up position, based on a detection result of the detection unit, at which the sheet feeding unit feeds the sheet stacked on the sheet stacking unit, wherein, before feeding of the sheet stacked on the sheet stacking unit by the sheet feeding unit, the controller controls the DC motor so as to rotate for a predetermined period of time to raise the sheet stacking unit higher than the lift-up position and then controls the DC motor so as to rotate reversely to lower the sheet stacking unit to the lift-up position.

3. An image forming apparatus comprising:

a sheet accommodating unit which is detachably attached to an apparatus main body and configured to accommodate sheets;

a sheet stacking unit which is provided in the sheet accommodating unit and can move while supporting the sheet;

a sheet feeding unit configured to feed the sheet stacked on the sheet stacking unit;

a lift unit configured to move the sheet stacking unit toward the sheet feeding unit, the lift unit including a pulse motor to raise the sheet stacking unit;

a detection unit configured to detect a position of an uppermost surface of the sheet stacked on the sheet stacking unit, and a controller configured to control the lift unit so as to move the sheet stacking unit to a lift-up position, based on a detection result of the detection unit, at which the sheet feeding unit feeds the sheet stacked on the sheet stacking unit, wherein, before feeding of the sheet stacked on the sheet stacking unit by the sheet feeding unit, the controller controls the pulse motor so as to rotate by a predetermined number of pulses to raise the sheet stacking unit higher than the lift-up position and then controls the pulse motor so as to rotate reversely to lowers the sheet stacking unit to the lift-up position.

4. The image forming apparatus comprising:

a sheet accommodating unit which is detachably attached to an apparatus main body and configured to accommodate sheets;

a sheet stacking unit which is provided in the sheet accommodating unit and can move while supporting the sheet;

a sheet feeding unit configured to feed the sheet stacked on the sheet stacking unit;

a lift unit configured to move the sheet stacking unit toward the sheet feeding unit, the lift unit including a DC motor to raise the sheet stacking unit;

a detection unit configured to detect a position of an uppermost surface of the sheet stacked on the sheet stacking unit, and a controller configured to control the lift unit so as to move the sheet stacking unit to a lift-up position, based on a detection result of the detection unit, at which the sheet feeding unit feeds the sheet stacked on the sheet stacking unit, wherein, before feeding of the sheet stacked on the sheet stacking unit by the sheet feeding unit, the controller controls the DC motor so as to rotate for a predetermined period of time to raise the sheet stacking unit higher than the lift-up position and then controls the DC motor so as to rotate reversely to lower the sheet stacking unit to the lift-up position.

* * * * *